US005094006A

United States Patent [19]

Varney

[11] Patent Number: 5,094,006

[45] Date of Patent: Mar. 10, 1992

[54] SWAG

[75] Inventor: Brian A. Varney, Coventry, England

[73] Assignee: Parkhill Blinds and Curtains Limited, Coventry, United Kingdom

[21] Appl. No.: 467,603

[22] Filed: Jan. 19, 1990

[30] Foreign Application Priority Data

Jan. 19, 1989 [GB] United Kingdom ..... 8901166

[51] Int. Cl.[5] ..... G01B 3/14

[52] U.S. Cl. ..... 33/563; 33/14

[58] Field of Search ..... 33/14, 16, 562, 563, 33/565

[56] References Cited

U.S. PATENT DOCUMENTS

| | | | |
|---|---|---|---|
| 622,419 | 4/1899 | Cunningham | 33/14 |
| 1,260,849 | 3/1918 | Zech | 33/14 |
| 1,742,684 | 1/1930 | Bowman | 33/563 |
| 2,186,325 | 1/1940 | Bukovy | 33/14 |
| 3,645,003 | 2/1972 | Gass | 33/663 |
| 3,664,026 | 5/1972 | Lawson | 33/563 |
| 4,265,020 | 5/1981 | Werber | 33/14 |

*Primary Examiner*—Thomas B. Will

*Attorney, Agent, or Firm*—Ware, Fressola, Van Der Sluys & Adolphson

[57] ABSTRACT

A swag (10) for decorative use in curtaining is made using a template (11) which may be of rigid sheet material and formed by two side edges (14), each bearing deep cut-outs (15, 16 . . . ) and projections (17). The side edges taper outwardly from top to bottom and their separation, but not their inclination, can be adjusted using an adjustable slide (22) having a scale (24).

7 Claims, 3 Drawing Sheets

SWAG

BACKGROUND OF THE INVENTION

1. Field of the Invention

This invention relates to the manufacture of decorative swags and to swags thus made.

2. Description of the Prior Art

Curtains, archways and walls can have textile fabric draped in hanging loops to form swags which are attractive to look at and can also be used to hide unattractive or utilitarian features of a room. However, the design and construction of swags has hitherto been a specialist job, since each swag has had to be individually cut out and draped so as to have the required depth and width and fullness and so as to hang gracefully.

In general, swags are cut out by trial and error methods, the lower edge is finished by seaming or trimming, and the swag is gathered into hanging folds by the installer, with excess material being cut away at the time of installation. This may leave raw, unfinished edges subject to fraying if it is necessary to remove the swag for cleaning or to permit re-decorating. Additionally, the ordinary householder cannot readily install, remove or replace the traditional swag with ease.

These problems arise because of the inaccurate cutting and assembling method traditionally used, which requires skill and experience to carry out. The cost of installing swags is therefore very high. The finished product is often less attractive than desired because of unevenness in the draping of the fabric and excessive bulk and weight. This also means that a great deal of fabric is needed, adding to expense.

SUMMARY OF THE INVENTION

It is an object of a first aspect of the present invention to provide a template or pattern for manufacture of a decorative swag which overcomes or reduces some or all of these disadvantages.

According to this aspect of the invention, there is provided a template or pattern for the manufacture of a decorative swag comprising a pair of opposite side edge elements, each having a profile including a plurality of deep arcuate cut-outs separated by projections, the said profiles being generally outwardly inclined away from each other considered from top to bottom of the template or pattern; and guide means enabling the separation of the opposite side edge elements to be selectively adjusted.

The template or pattern may include an arcuate lower edge element and an upper edge element linking the side edge elements. The upper edge element may be straight.

Each projection may have a marking guide for marking the swag to indicate the hanging position of each projecting portion thereof.

The deep arcuate cut-outs have a depth at least approximately as great as their height.

The template or pattern may be of rigid or semirigid sheet material or may be of flexible sheet material. Alternatively, it may comprise a rigid framework defining said edge elements only. The template may form part of a cutting machine assembly.

Where the template or pattern is rigid or semirigid, the guide means may comprise a slidable connection or a linkage enabling the side edge elements to be moved relative to each other without changing their angular inclination with respect to each other.

Where the template or pattern is of flexible sheet material, the guide means may comprise markings indicating a vertical pleating or overlap line at which adjustment to the width of the template or pattern is to be made.

It is an object of a further aspect of the invention to provide a swag for decorative use which is capable of being installed and removed with minimal skill or experience.

Accordingly to this aspect, the invention provides a swag comprising a fabric member having a top edge, an arcuate lower edge and a pair of side edges, the side edges each having a profile including a plurality of deep arcuate cut-outs separated by projections, and said profiles being generally outwardly inclined away from each other considered from the top to the lower edge, each of said projections having a marking to indicate the hanging position of the projecting portion.

The swag may have all of its edges finished by seaming or overseaming.

From a further aspect, there is provided, in combination with a swag as set out above, a fixture to which the swag is adapted to be secured, the fixture having attachment means for attachment of the top edge, and of each of said projections of the side edges.

The attachment means may comprise studs, hooks or a touch-and-close type of fastener material.

The fixture may comprise a board having a continuous strip of touch-and-close fastener material attached along its length.

BRIEF DESCRIPTION OF THE SEVERAL VIEWS OF THE DRAWINGS

A swag and a template or pattern for manufacturing such a swag will now be described by way of example only, with reference to the accompanying drawings, in which.

DETAILED DESCRIPTION OF THE PREFERRED EMBODIMENTS

Figure 1:
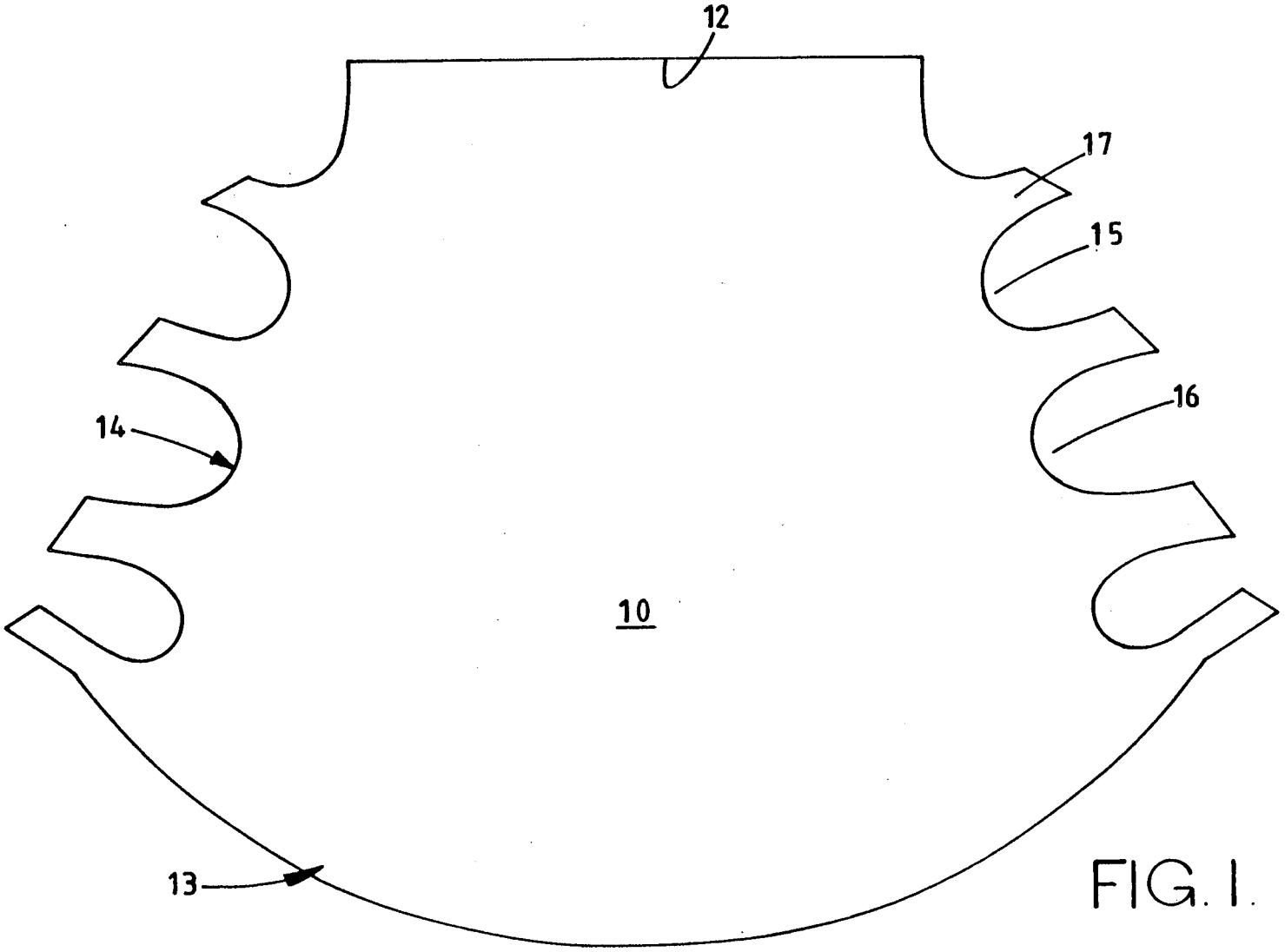
FIG. 1 is a front view of a swag ready for hanging.

A swag 10 is made of fabric by cutting out using a template or pattern 11. The template 11 has a straight top edge 12, an arcuate lower edge 13, spaced from the top edge by a distance substantially greater than the intended depth of the swag when hung, and a pair of side edges 14, linking the top and lower edges 12 and 13.

The side edges 14 are mirror images of each other. In overall outline they are inclined away from each other considered from the top to the lower edge of the template. Within this overall outline, the edge elements each have a profile which includes a plurality of deep cut-outs 15, 16, . . . for example.

The cut-outs are arcuate and have a depth which is at least approximately as great as their width. Although it may be possible to use a shallow form of cut-out, the drape of the swag is improved and the bulk is reduced by using deep cut-outs somewhat as shown.

Figure 2:
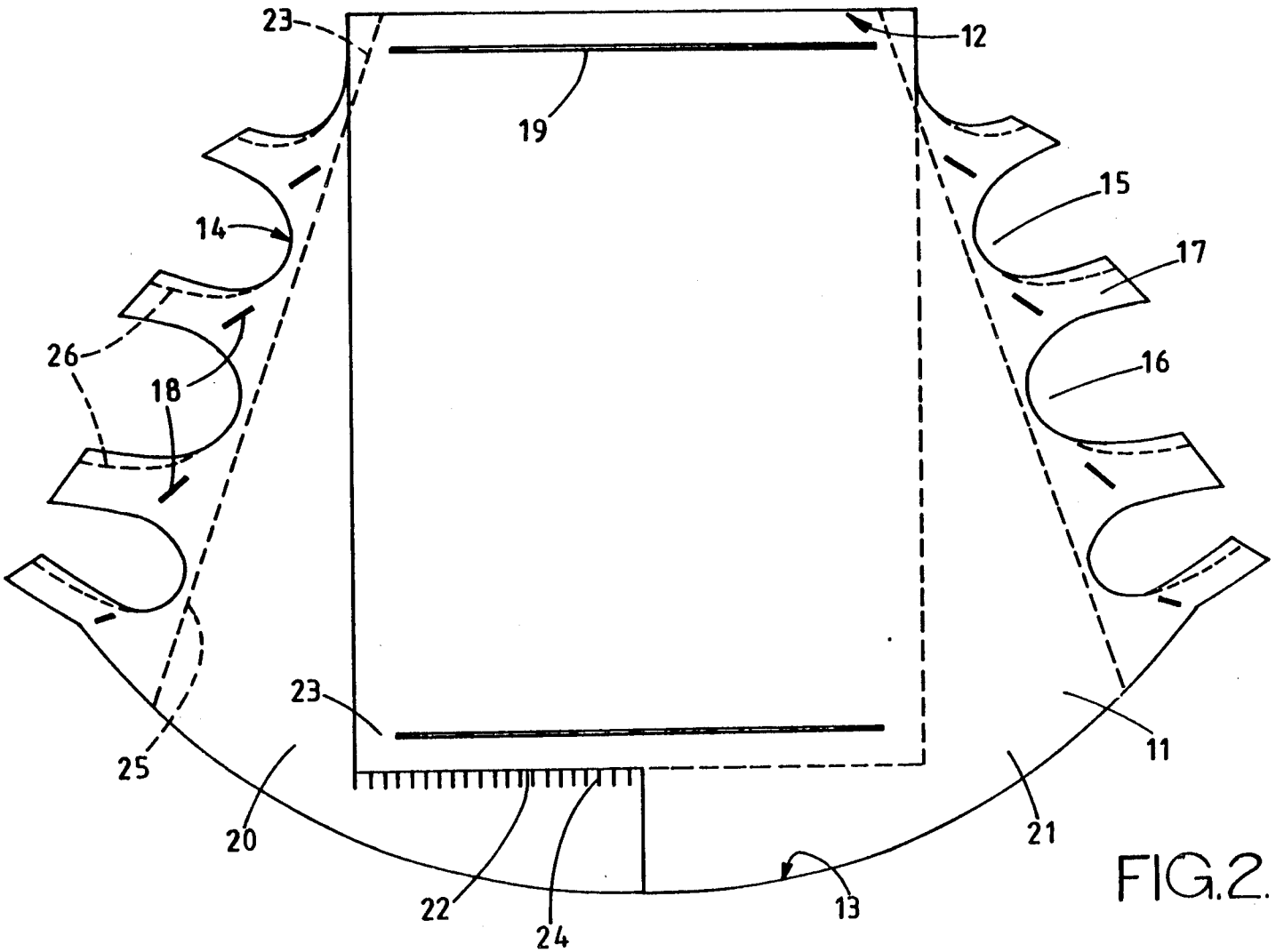
FIG. 2 is a similar view of a template or pattern for making the swag of FIG. 1.

Projections 17 are left between the cut-outs 15, 16, . . . On the template of pattern, as shown in FIG. 2 each of these projections 17 includes a slot 18, which is used to mark the fabric of the swag so that it can be hung readily, as will later be described. A slot 19 is provided on the template along the top edge. Again, this is used to transfer hanging markings to the fabric.

The two side edges 14 are spaced by a distance which is related to the intended final width of the swag when hung. In order to make swags 10 of different widths, the separation, but not the angular inclination of the side edge elements 14 of the template is adjusted.

This adjustment is achieved by arranging a guide means between two parts 20, 21 forming the left and right hand parts of the template. In the example shown, in FIG. 2 the guide means comprises an adjustable slide 22, linking the two parts 20 and 21 and provided with fixing means such as one or more screws 23 to secure the side edge members 14 at a suitable separation. The separation required can be calculated from the desired width of swag by the use of a table of predetermined sizes. The actual size can be read from a suitable scale 24 provided on the template.

It will be seen that the template also carries markings 25 to indicate cutting lines for an interlining for the swag. The swag and its lining will be cut from the full size of the template or pattern, but the interlining, added to give "body" to the swag, will only be cut to the markings 25, so as not unduly to stiffen the end parts of the swag which will be gathered into folds for hanging.

Further markings 26 are provided on the upper edges of each of the projections 17. These markings 26 indicate the portions of the fabric of the swag which are to be folded over when the swag is being hung to form the tops of the draped folds of the swag.

The swag will normally be cut out with the material on the bias (with its weave diagonal) to achieve a good draped appearance. However, it can be cut out on the straight weave of the fabric, for example if the fabric carries a strong pattern.

Figure 3:
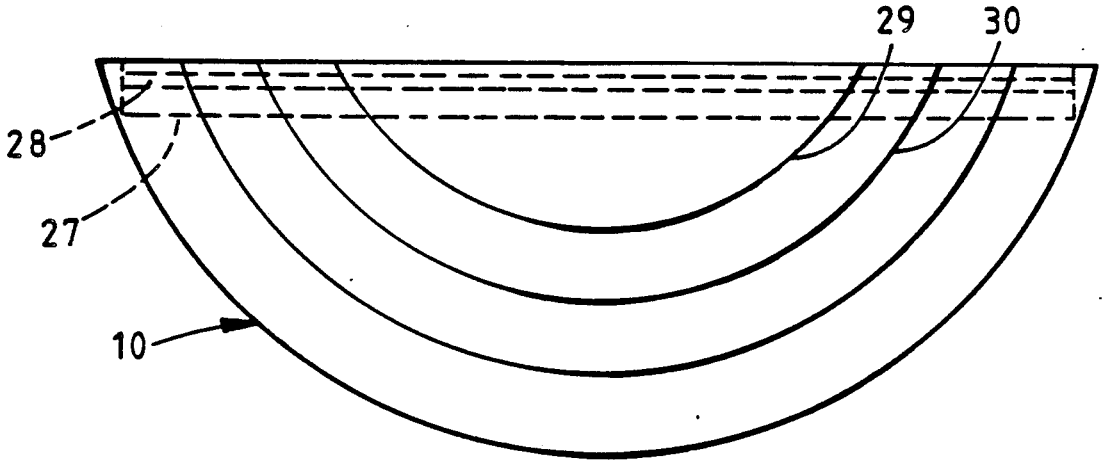
FIG. 3 is a diagrammatic view of the swag when hung.

In order to hang the swag of FIG. 1, a fixture such as a board 27 is used. This can be seen in FIG. 3 and carries attachment means for the swag. These may be for example, hooks, studs, tacks, gimps or staples at spaced positions along the board, but preferably comprise a strip 28 of touch-and-close fastener material extending along the length of the board at the rear.

The swag is hung by firstly centering the fabric and then attaching it to the touch-and-close fastener strip 28 at the position which has been marked on the top edge using the slot 19 of the template or pattern. The first set of projections 17 is then hung onto the touch-and-close fastener strip 28, using the markings made through the slots 18 of the template. The upper edges of the projections are folded over to conceal the cut-out edge and to afford a start to the first fold or drape of the swag, shown at 29 in FIG. 3.

The process is repeated with the second set of projections being attached at their markings to the board, with their upper edges turned under to conceal the cut-outs and to afford a start to the second fold or drape 30.

It will be appreciated that, once the swag has been manufactured using the template or pattern, it can very readily be hung by someone without skill or experience in this field. It can also be removed and replaced without difficulty in order to wash or clean the fabric, or for purposes of re-decoration. The arrangement of a plurality of swags can be changed at will to alter the aesthetic effect. All that is necessary is to hang the markings in the correct order and positions, slightly turn under the upper edges of the cut-outs and ease the resulting folds or drapes into shape.

The ends of the swag or swags can be trimmed by the use of folded or draped tails of generally conventional design (not shown), which can also be hung from the touch-and-close fastener strip 28.

The template or pattern enables the manufacturer or even any competent seamstress to make consistently good swags which have adequate but not excessive weight and fullness, which drape well and which have finished edges all round so as not to fray in use.

The template described above is made of rigid or semi-rigid sheet material. A simple pattern can be made using paper or other non-rigid material marked with guide means such as a vertical pleating or overlap line for adjusting the separation of the side edges if desired.

Alternatively, sheet material need not be used at all. The template could merely comprise a framework defining the edges referred to. This could be combined with a fabric cutting machine to guide a cutter.

Although the lower edge of the swag will normally be arcuate and the upper edge straight, the lower edge could have superimposed formations such as scallops and the upper edge could follow a shallow curve for example.

I claim:

1. A template for the manufacture of a decorative swag of a type in which a fabric is allowed to hang in a plurality of loop-like generally concentric folds, the template comprising a pair of opposite side edge elements and guide means enabling the separation of the opposite side edge elements to be selectively adjusted, characterized in that each side edge element has a profile defining a plurality of deep arcuate cut-outs separated by projections, the profiles being generally outwardly inclined away from each other considered from top to bottom of the template, the deep arcuate cut-outs having a depth at least approximately as great as their height, and each said projection including marking means adapted to mark a hanging position on the decorative swag such that side by side assembly of the corresponding hanging positions of the swag promotes the formation of said loop-like generally concentric folds therein.

2. A template according to claim 1 and made of rigid material and having an arcuate lower edge element and an upper edge element linking the side edge elements.

3. A template according to claim 2 wherein the guide means comprise a slidable connection enabling the side edge elements to be moved relative to each other without changing their angular inclination with respect to each other.

4. A template according to claim 1 and made of flexible sheet material wherein the guide means comprise markings indicating a vertical overlap line at which adjustment to the width of the template is to be made.

5. A template according to claim 1 arranged to form part of a cutting machine assembly.

6. A template according to claim 2 arranged to form part of a cutting machine assembly.

7. A template according to claim 3 arranged to form part of a cutting machine assembly.

* * * * *